US009655394B2

(12) United States Patent
Frimpong

(10) Patent No.: US 9,655,394 B2
(45) Date of Patent: May 23, 2017

(54) TWO PIECE BUTTERFLY BOW TIE

(71) Applicant: John Mensah Frimpong, London (GB)

(72) Inventor: John Mensah Frimpong, London (GB)

( * ) Notice: Subject to any disclaimer, the term of this patent is extended or adjusted under 35 U.S.C. 154(b) by 0 days.

(21) Appl. No.: 14/544,912

(22) Filed: Mar. 9, 2015

(65) Prior Publication Data

US 2015/0257467 A1 Sep. 17, 2015

(30) Foreign Application Priority Data

Mar. 13, 2014 (GB) ..... 4035793
Feb. 10, 2015 (EP) ..... 1430474

(51) Int. Cl.
*A41D 25/14* (2006.01)
*A41D 25/06* (2006.01)

(52) U.S. Cl.
CPC ..... *A41D 25/06* (2013.01)

(58) Field of Classification Search
CPC ..... A41D 25/002; A41D 25/00; A41D 25/02; A41D 25/04
See application file for complete search history.

(56) References Cited

U.S. PATENT DOCUMENTS 387,231 A * 8/1888 Harrison ..... 2/148
460,259 A * 9/1891 Bartlett ..... 2/152.1
658,177 A * 9/1900 Horn ..... 24/53
698,219 A * 4/1902 Palmer ..... 24/53
967,792 A * 8/1910 Loomis ..... 2/144
1,373,949 A * 4/1921 Chauncey ..... 2/151
1,456,757 A * 5/1923 Berkson ..... 2/151
1,457,559 A * 6/1923 Stonge ..... 2/151
1,540,037 A * 6/1925 Smith ..... 2/151
1,552,240 A * 9/1925 Sokolowski ..... 2/144
1,561,959 A * 11/1925 Turiga ..... 2/144
1,582,558 A * 4/1926 Taylor ..... 2/133
1,646,295 A * 10/1927 Kimmel ..... A41D 25/02 2/151
1,692,991 A * 11/1928 Howard ..... 2/151
1,737,072 A * 11/1929 Blach ..... 2/151
1,800,729 A * 4/1931 Hodges ..... A41D 25/04 2/151
2,045,279 A * 6/1936 Mayer ..... 2/155
2,045,280 A * 6/1936 Mayer ..... 2/155
2,061,630 A * 11/1936 Keys ..... 2/155
2,413,318 A * 12/1946 Golfieri ..... 2/207
2,430,607 A * 11/1947 Gaskouitz ..... 40/586
2,462,727 A * 2/1949 Danelz ..... 2/91
2,510,323 A * 6/1950 Taborski ..... 2/151
2,578,269 A * 12/1951 Sinton ..... 2/151
2,709,813 A * 6/1955 Clendenin, Jr. ..... 2/130
2,844,821 A * 7/1958 Shurtz ..... 2/154
3,034,134 A * 5/1962 Peterson ..... 2/151
3,080,566 A * 3/1963 Neumann ..... 2/91
3,218,650 A * 11/1965 Less ..... 2/154

(Continued)

*Primary Examiner* — Richale Quinn
*Assistant Examiner* — Anne Kozak
(74) *Attorney, Agent, or Firm* — Chen-Chi Lin

(57) ABSTRACT

A hand tied, bow of novel two piece construction is disclosed. A first piece is an adjustable neck strap. A second piece is a folded (by hand or button) butterfly bow. Forming the finished bow tie, a user places the neck strap around the neck of the folded bow, then ties a knot which gives the bow tie an appearance of a tie-it-yourself bow tie. The finished article is then placed around the user's neck.

10 Claims, 4 Drawing Sheets

(56) References Cited

U.S. PATENT DOCUMENTS

| | | | | | |
|---|---|---|---|---|---|
| 3,261,025 | A | * | 7/1966 | Simek | 2/149 |
| 3,613,117 | A | * | 10/1971 | Gingerich | 2/149 |
| 3,777,312 | A | * | 12/1973 | Najarian | 2/154 |
| D315,467 | S | * | 3/1991 | Lemmon | D6/597 |
| 5,361,413 | A | * | 11/1994 | Schaefer | 2/144 |
| D368,572 | S | * | 4/1996 | Pon et al. | D2/606 |
| D389,285 | S | * | 1/1998 | Falloon | D2/608 |
| 6,243,874 | B1 | * | 6/2001 | Yoon | 2/144 |
| D534,333 | S | * | 1/2007 | Jones | D2/606 |
| D547,026 | S | * | 7/2007 | Grison | D2/606 |
| D621,133 | S | * | 8/2010 | Zakheim | D2/853 |
| 7,788,738 | B1 | * | 9/2010 | Haworth | 2/279 |
| D688,441 | S | * | 8/2013 | Kim | D2/606 |
| D690,077 | S | * | 9/2013 | Kim | D2/606 |
| D696,838 | S | * | 1/2014 | Kim | D2/606 |
| D697,821 | S | * | 1/2014 | Kim | D9/721 |
| D723,388 | S | * | 3/2015 | Kim | D9/721 |

* cited by examiner

TWO PIECE BUTTERFLY BOW TIE

CLAIM OF PRIORITY

The present invention was registered with the UK Patent Office on the 13 Mar. 2013.

The registration number is 4035793 with a design classification LOC (07) C1. 02-05

FIELD OF THE INVENTION

This invention concerns neckwear apparel, particularly bow ties using a button and neck strap.

BACKGROUND OF THE INVENTION

Despite growing popularity with the general male consumer, the bow tie has never been able to dominate the neckwear market. The main reason for this is prospective bow tie wearers do not know how to properly tie a bow tie. This setback of knowledge was addressed by the manufacturers and the proposed solution was the introduction of ready made and clip-on bow ties.

Without a doubt, the new inventions filled a gap in the market. But, the flat machine made bow ties prove to be the drawback to this day. The new inventions failed to satisfy the consumers' desire for a hand tied bow tie that was easy to construct and easy to put on. My invention solves this problem.

SUMMARY OF INVENTION

The present invention relates to a hand tied bow tie of novel two piece construction. The bow is folded into the shape of a butterfly by hand or by button. The neck strap, the other piece is tied in a knot form around the neck of the butterfly shape, thus allowing easy application about the neck of the eventual user.

As a result, the bow tie prepared in accordance with the present invention is identical in appearance with a traditional hand tied bow tie.

For better understanding of the invention and the advantages, references will be made to the following description and accompanying drawings. The accompanying drawings will form a material part of this disclosure.

DETAILED DESCRIPTION OF INVENTION

A bow tie is a type of necktie. It consists of a ribbon of fabric tied around the collar of a shirt in a symmetrical manner. Bow ties are made of any fabric material, but most are made of silk, polyester, cotton or a mixture of fabrics.

There are three popular types of shapes for a bow tie, butterfly, pointed and straight end. The most popular process to tie a bow tie can be best described as hand tied, ready tied and clip-on.

Figure 1:
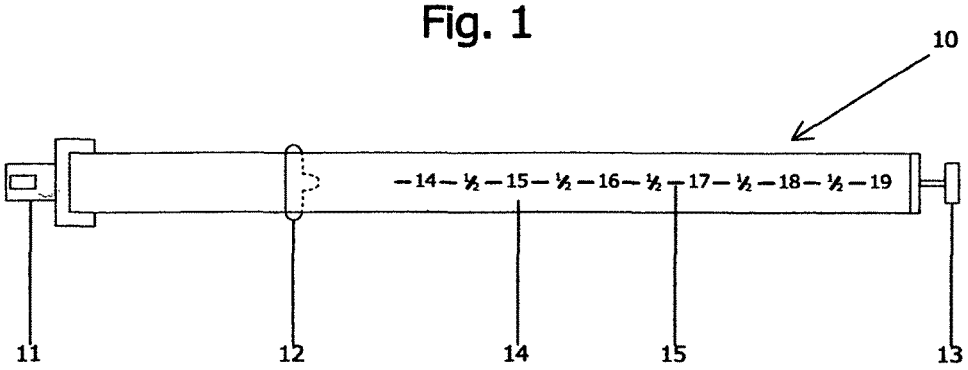
FIG. 1 is a drawing showing a open adjustable neck strap.

FIG. 1 Is a drawing showing a open adjustable neck strap, consisting of two hooks on either end of the strap with the eye positioned between the hooks. The neck strap is also numbered by size with eyelets.

Figure 2:
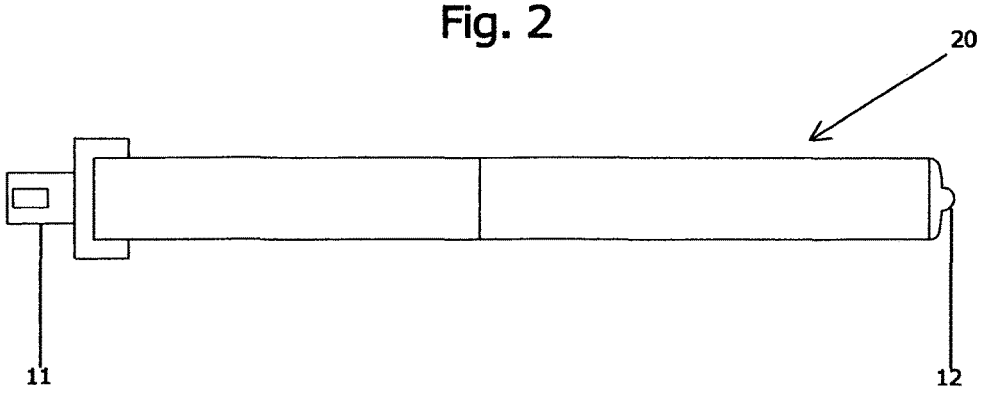
FIG. 2 is a drawing showing a neck strap folded to fit a size of a neck of a user.

FIG. 2 Is a drawing showing a neck strap folded to the users size. The right hand hook is placed in the numbered eyelet and the actual hook will be concealed on appearance. The eye then moves along the strap and replaces the hook that was originally on the right hand side.

Figure 3:
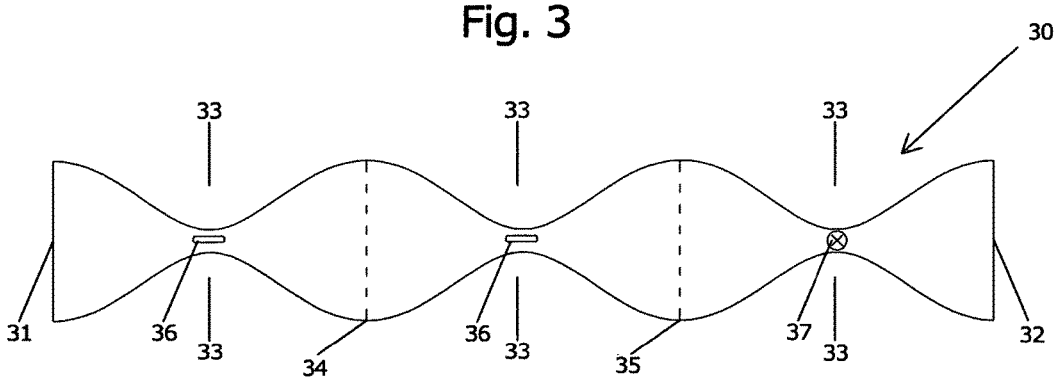
FIG. 3 is a drawing showing the open bow tie shape.

FIG. 3 Is a drawing showing the shape of the open bow tie. The left hand side consists of two panels, two necks and a button hole. The middle of the bow consists of two necks, two panels and a button hole and on the right hand side consists of two necks, two panels and a button.

Figure 4:
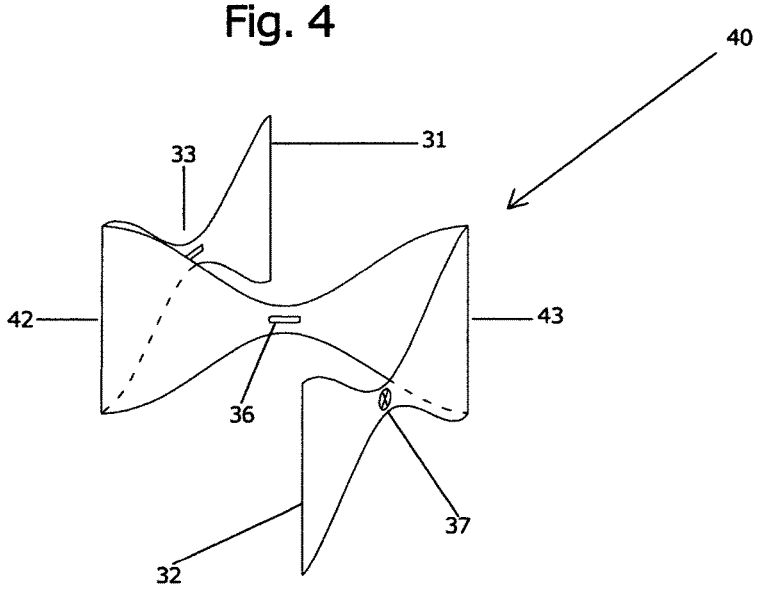
FIG. 4 is a drawing showing the folding process of the bow.

FIG. 4 Is a drawing showing the folding process of the bow in the butterfly shape. The user folds the left side leaf backwards and then folds the left panel, button hole and neck left to right. The next process is to fold the right side leaf forwards and then fold the panel, the neck and the button right to left. The button will then pass through the button hole situated between the two necks in the middle and then through the button hole between the two necks of the left panel.

Figure 5:
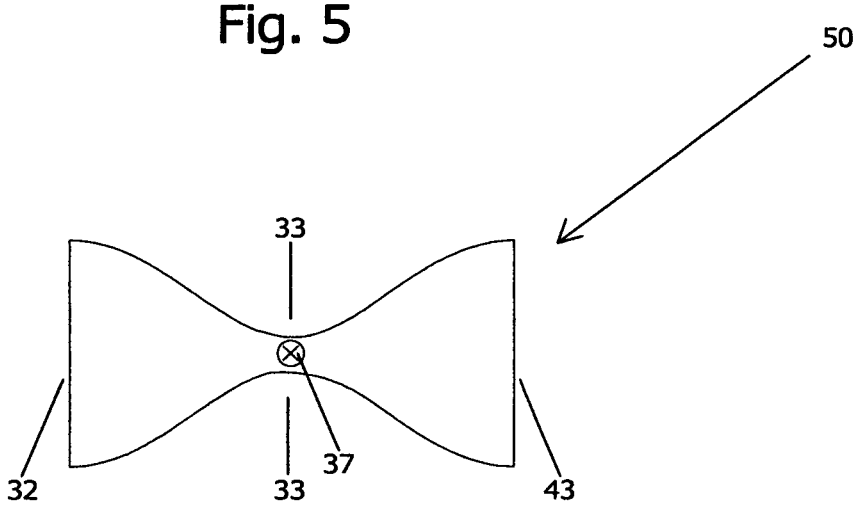
FIG. 5 is a drawing showing the folded bow in the shape of the butterfly.

FIG. 5 Is a drawing showing the folded bow in the shape of the butterfly. The butterfly consists of a right and left panel a button in between two necks.

Figure 6:
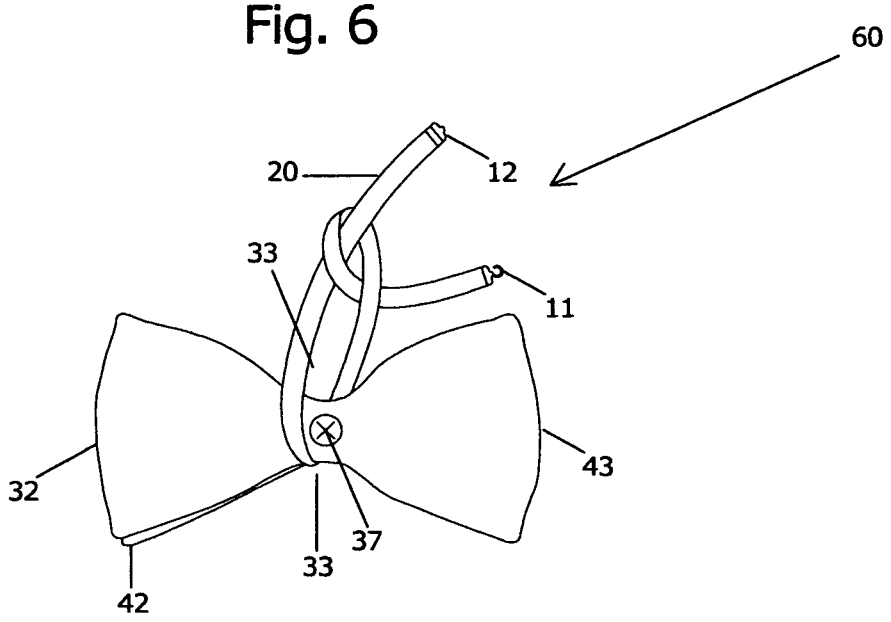
FIG. 6 is a drawing showing the neck strap being tied in a knot around the butterfly bow.

FIG. 6 Is a drawing showing the sized adjusted neck strap with a hook and eye on either end. The neck strap is placed around the two necks of the butterfly bow with a panel on either side ready to knot. The knot will eventually conceal the button.

Figure 7:
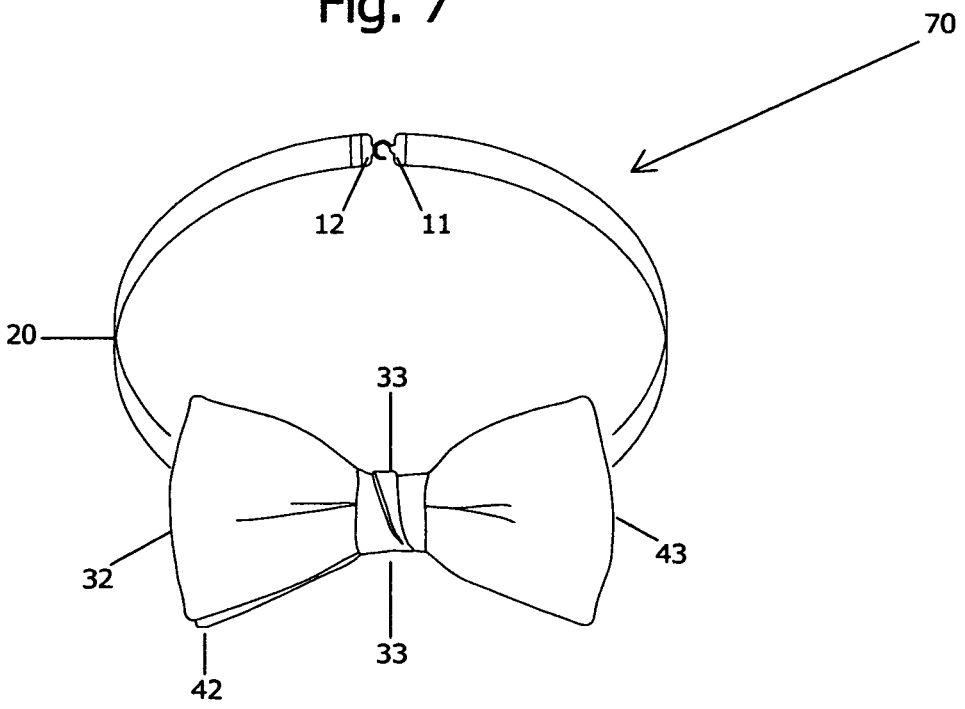
FIG. 7 is a drawing showing the finished invention ready to wear around the user's neck.

FIG. 7 Is a drawing showing the finished invention, a two piece bow tie. The neck strap is connected by the hook and the eye and has a firm knot concealing the button around the two breaks of the butterfly bow with a panel on either side of the knot.

REPRESENTATIVES EMBODIMENTS

FIG. 1 is a view showing one piece of two of the invention, a open neck strap (10). On either end of the neck strap hooks are visible, left side hook (11) and the right side hook (13) and between the hooks we have the 'eye' (12). All three embodiments will eventually act as connectors. Also visible on the neck strap (10) are numbers (14), the numbers correspond to the users neck size and next to each number we have eyelets (15) that will eventually connect with the right side hook (13).

FIG. 2 is a view showing one piece of two of the invention, a folded neck strap (20). On either end of the neck strap hooks are visible, left side hook (21) and the right side the 'eye' (22). These two hooks will eventually act as connectors. From FIG. 1 Hook (13) has now connected with the eyelet (15) and is concealed as are the numbers (14).

FIG. 3 is a view showing piece two of two of the invention, the pre-folded shape of the invention (30). The shape consists of two panels (31), six necks (32), two leafs (33) and two button holes (34). The dotted lines are not part of the design.

FIG. 4 is a view showing the folding process of the invention (40). The user folds the left leaf (41) backwards creating a new panel (42) by aligning the necks (43) and button holes (44). The next step is to fold the right leaf (41)

forward, creating a new panel (42) by aligning the button (45) to the button holes (44). The final step is to pass the button (45) through the button holes (44) which are situated on the necks (43).

FIG. 5 is a view showing the folded invention in the shape of the butterfly (50). The butterfly bow consists of two panels (51) right and left, two necks (52) and a button (53) located between the necks (52) of the butterfly bow.

FIG. 6 is a view showing the invention (60) with a folded neck strap (61) with a hook (62) and the 'eye' (63) on either end. It is wrapped around the two necks (64) and button (65) ready to be tied into a knot. Also visible are the two panels (66) that form the butterfly shape.

FIG. 7 is a view showing the finished invention, the two piece bow tie (70). The two panels (75) form the shape of the bow tie commonly known as the butterfly. The neck strap (71), with a hook (73) and the 'eye' (74) on either end is wrapped around the neck (72) of the butterfly bow, (concealing the button holding the bow together) forming a knot. By proceeding in the manner described one is able to obtain a hand tied looking bow tie of attractive appearance. The resulting bow tie can be put by the user by merely connecting the hook (73) and the 'eye' (74) together. In examples of the present disclosure, the knot conceals an entirety of the button (65). See FIGS. 6 and 7.

In examples of the present disclosure, the first and second button holes (34) of FIG. 3 and (44) of FIG. 4 are of rectangular shapes. See FIGS. 3 and 4.

I claim:

1. A two-piece constructed, hand-tied bow tie comprising:

an adjustable neck strap; and a bow consisting of fabric having a first portion, a second portion, and a third portion; the first, second and third portions being of a same length, the first portion having a first button hole at a center of the first portion, the second portion having a second button hole at a center of the second portion, the third portion having a button attached to a surface of the fabric at a center of the third portion;

wherein the two-piece constructed, hand-tied bow tie is characterized by:

an expanded condition in which the first, second and the third portions are flat and are along a longitudinal axis passing through a center of the first button hole, a center of the second button hole, and a center of the button;

the first portion, the second portion, and the third portion each have a first surface and a second surface opposite the first surface;

the first portion is symmetric with respect to a first axis passing through the center of the first button hole; the first axis is perpendicular to the longitudinal axis and a normal direction of the first surface of the first portion;

the second portion is symmetric with respect to a second axis passing through the center of the second button hole; the second axis is parallel to the first axis;

the third portion is symmetric with respect to a third axis passing through the center of the button; the third axis is parallel to the first axis; and an assembled condition in which the bow is folded so that the first button hole, the second button hole, and the button are aligned; the button passes through the first and second button holes;

and the adjustable neck strap wraps around a middle section of the folded bow so as to form a knot concealing the button.

2. The two-piece constructed, hand-tied bow tie of claim 1, wherein the first surface of the first portion and the first surface of the second portion are of a same surface area.

3. The two-piece constructed, hand-tied bow tie of claim 1, wherein the first, second, and third portions each have a maximum width at two longitudinal ends.

4. The two-piece constructed, hand-tied bow tie of claim 1, wherein the first portion has a first minimum width along the first axis; the second portion has a second minimum width along the second axis; and the third portion has a third minimum width along the third axis.

5. A method of preparing an assembled condition of a two-piece constructed, hand-tied bow tie comprising:

an adjustable neck strap; and a bow consisting of fabric having a first portion, a second portion, and a third portion; the first, second and third portions being of a same length, the first portion having a first button hole at a center of the first portion, the second portion having a second button hole at a center of the second portion, the third portion having a button attached to a surface of the fabric at a center of the third portion;

wherein the two-piece constructed, hand-tied bow tie is characterized by:

an expanded condition in which the first, second and the third portions are flat and are along a longitudinal axis passing through a center of the first button hole, a center of the second button hole, and a center of the button;

the first portion, the second portion, and the third portion each have a first surface and a second surface opposite the first surface;

the first portion is symmetric with respect to a first axis passing through the center of the first button hole; the first axis is perpendicular to the longitudinal axis and a normal direction of the first surface of the first portion;

the second portion is symmetric with respect to a second axis passing through the center of the second button hole; the second axis is parallel to the first axis;

the third portion is symmetric with respect to a third axis passing through the center of the button; the third axis is parallel to the first axis; and the assembled condition in which the bow is folded so that the first button hole, the second button hole, and the button are aligned; the button passes through the first and second button holes;

and the adjustable neck strap wraps around a middle section of the folded bow so as to form a knot concealing the button, the method comprising the steps of:

preparing the expanded adjustable neck strap and the expanded bow;

folding the first portion backward so that the second surface of the first portion faces the second surface of the second portion;

folding the third portion forward so that the first surface of the third portion faces the first surface of the second portion;

aligning the first and second button holes and the button;

passing the button through the first and second button holes; and wrapping the expanded adjustable neck strap around the middle section of the folded bow so as to form the knot concealing the button.

6. The two-piece constructed, hand-tied bow tie of claim 1, wherein the folded bow is of a bow tie shape.

7. The two-piece constructed, hand-tied bow tie of claim 1, wherein the two-piece constructed, hand-tied bow tie is further characterized by the expanded condition in which the first portion is directly connected to the second portion; the second portion is directly connected to the third portion; and the second portion is in between the first and third portions.

8. The two-piece constructed, hand-tied bow tie of claim 1, wherein the two-piece constructed, hand-tied bow tie is further characterized by the assembled condition in which the knot conceals an entirety of the button.

9. The two-piece constructed, hand-tied bow tie of claim 1, wherein the first and second button holes are of rectangular shapes.

10. A two-piece constructed, hand-tied bow tie comprising:

an adjustable neck strap; and a bow consisting of fabric having a first portion, a second portion, and a third portion; the first, second and third portions being of a same length, the first portion having a first button hole at a center of the first portion, the second portion having a second button hole at a center of the second portion, the third portion having a button attached to a surface of the fabric at a center of the third portion;

wherein the two-piece constructed, hand-tied bow tie is characterized by:

an expanded condition in which the first, second and the third portions are flat and are along a longitudinal axis passing through a center of the first button hole, a center of the second button hole, and a center of the button;

the first portion, the second portion, and the third portion each have a first surface and a second surface opposite the first surface;

the first portion is symmetric with respect to a first axis passing through the center of the first button hole; the first axis is perpendicular to the longitudinal axis and a normal direction of the first surface of the first portion;

the second portion is symmetric with respect to a second axis passing through the center of the second button hole; the second axis is parallel to the first axis;

the third portion is symmetric with respect to a third axis passing through the center of the button; the third axis is parallel to the first axis; and an assembled condition in which the bow is folded so that the first button hole, the second button hole, and the button are aligned; the button passes through the first and second button holes;

and the adjustable neck strap wraps around a middle section of the folded bow so as to form a knot concealing the button; and wherein the adjustable neck strap consisting of an adjustable length strap with a left side hood and a right side hook.

* * * * *